US011116689B2

(12) United States Patent
Petersen

(10) Patent No.: US 11,116,689 B2
(45) Date of Patent: Sep. 14, 2021

(54) CANE MOBILITY DEVICE

(71) Applicant: Katherine Anne Petersen, Dallas, TX (US)

(72) Inventor: Katherine Anne Petersen, Dallas, TX (US)

( * ) Notice: Subject to any disclaimer, the term of this patent is extended or adjusted under 35 U.S.C. 154(b) by 0 days.

(21) Appl. No.: 16/781,644

(22) Filed: Feb. 4, 2020

(65) Prior Publication Data

US 2021/0236378 A1 Aug. 5, 2021

(51) Int. Cl.
*A61H 3/06* (2006.01)
*A45B 3/08* (2006.01)

(52) U.S. Cl.
CPC ..... *A61H 3/061* (2013.01); *A45B 3/08* (2013.01); *A61H 3/068* (2013.01); *A61H 2003/063* (2013.01); *A61H 2201/0184* (2013.01); *A61H 2201/5058* (2013.01)

(58) Field of Classification Search
None
See application file for complete search history.

(56) References Cited

U.S. PATENT DOCUMENTS 4,280,204 A * 7/1981 Eichinger ..... G01S 15/18 367/116
4,858,125 A * 8/1989 Washizuka ..... A45B 3/00 600/301
5,687,136 A * 11/1997 Borenstein ..... G01S 15/88 367/116
5,807,111 A * 9/1998 Schrader ..... A61F 9/08 367/116
6,011,754 A * 1/2000 Burgess ..... A61H 3/061 367/102
6,489,605 B1 * 12/2002 Ritz ..... A61F 9/08 250/221
6,671,226 B1 * 12/2003 Finkel ..... A61H 3/061 367/116
6,722,610 B1 * 4/2004 Rawdon ..... B62D 7/1509 244/103 W
7,267,281 B2 * 9/2007 Hopkins ..... A61H 3/061 135/911
7,778,112 B2 * 8/2010 Behm ..... G01S 15/93 367/116
9,037,400 B2 * 5/2015 Tolstedt ..... A61H 3/061 701/411
9,201,143 B2 * 12/2015 Slamka ..... G01S 15/93
9,508,269 B2 * 11/2016 Slamka ..... G09B 21/006
9,591,902 B1 * 3/2017 Hyde ..... G08B 21/02
9,629,774 B2 * 4/2017 Dayal ..... A44C 15/0015
9,915,545 B2 * 3/2018 Chen ..... G01C 21/3629
9,922,236 B2 * 3/2018 Moore ..... G06F 3/005
9,953,547 B2 * 4/2018 Harish ..... G09B 21/007
10,024,679 B2 * 7/2018 Moore ..... G06F 3/016
10,024,680 B2 * 7/2018 Lee ..... G01C 21/3652
(Continued)

*Primary Examiner* — Muhammad Adnan
(74) *Attorney, Agent, or Firm* — Jackson Walker L.L.P.

(57) ABSTRACT

A cane apparatus may include a body portion, a handle at a top end of the body portion, a proximity detector coupled to the body portion, an alert mechanism, and a processor communicatively coupled to the proximity detector and the alert mechanism. The processor may be configured to: determine, based on a signal received from the proximity detector, that the proximity detector is within a threshold distance of an obstacle; and based on the determination, activate the alert mechanism.

19 Claims, 2 Drawing Sheets

(56) References Cited

U.S. PATENT DOCUMENTS 10,134,304 B1 * 11/2018 Beals ..... G01S 17/86
10,172,760 B2 * 1/2019 Hendrix ..... H04W 4/33
10,182,959 B2 * 1/2019 Padilla Arias ..... B06B 1/06
10,186,129 B2 * 1/2019 Hood ..... G08B 21/02
10,188,580 B2 * 1/2019 Dayal ..... H04W 4/40
10,360,907 B2 * 7/2019 Dayal ..... H04M 1/05
10,383,786 B2 * 8/2019 Pikle ..... A61H 3/061
10,395,486 B2 * 8/2019 Pajestka ..... G09B 21/001
10,404,950 B2 * 9/2019 Mali ..... G01S 15/04
2003/0016882 A1 * 1/2003 Riley ..... G01J 3/32 382/275
2003/0145881 A1 * 8/2003 Harroun ..... A61H 3/00 135/65
2004/0160318 A1 * 8/2004 Sasaki ..... E05F 15/43 340/522
2006/0028544 A1 * 2/2006 Tseng ..... A61H 3/061 348/62
2006/0118154 A1 * 6/2006 David ..... A61H 3/02 135/72
2007/0016425 A1 * 1/2007 Ward ..... G09B 21/003 704/271
2008/0088469 A1 * 4/2008 Doemens ..... A61H 3/061 340/686.6
2009/0025765 A1 * 1/2009 Behm ..... A61H 3/068 135/66
2009/0032590 A1 * 2/2009 Hopkins ..... A61H 3/061 235/385
2009/0242007 A1 * 10/2009 Heyer ..... A61H 3/0277 135/71
2013/0033964 A1 * 2/2013 Karl ..... B60R 16/0232 367/100
2013/0044005 A1 * 2/2013 Foshee ..... G01S 15/08 340/691.1
2013/0258078 A1 * 10/2013 Huang ..... A61H 3/061 348/62
2014/0055229 A1 * 2/2014 Amedi ..... G09B 21/001 340/4.1
2014/0132388 A1 * 5/2014 Alalawi ..... G09B 21/003 340/4.12
2014/0184384 A1 * 7/2014 Zhu ..... G09B 21/007 340/4.12
2015/0070479 A1 * 3/2015 Yu ..... A61H 3/068 348/62
2015/0113737 A1 * 4/2015 Davis ..... A47C 27/15 5/690
2016/0078278 A1 * 3/2016 Moore ..... G06K 9/00671 345/8
2016/0084952 A1 * 3/2016 Karlapalem ..... A61H 23/02 342/118
2016/0258758 A1 * 9/2016 Houston ..... G01C 21/20
2016/0278490 A1 * 9/2016 Rieker ..... A45B 9/04
2016/0300469 A1 * 10/2016 Hood ..... A45B 3/00
2017/0087023 A1 * 3/2017 Peli ..... A61H 3/061
2017/0213478 A1 * 7/2017 Kohn ..... G01S 19/13
2018/0110672 A1 * 4/2018 Kasravi ..... A01K 27/002
2018/0321045 A1 * 11/2018 Belt ..... G01C 21/206
2019/0038190 A1 * 2/2019 Zhong ..... A61B 5/14517
2019/0217924 A1 * 7/2019 Frizlen ..... G01S 15/58
2019/0227154 A1 * 7/2019 Viswanathan ..... G01S 7/64

* cited by examiner

CANE MOBILITY DEVICE

TECHNICAL FIELD

The present disclosure relates in general to mobility devices such as canes, and more particularly to canes that are useful to blind or vision-impaired individuals.

BACKGROUND

Various problems are known in the field of mobility devices for individuals who are blind or vision-impaired. For example, traditional "white canes" may be used to detect obstacles by tapping against them. But there is no existing way of detecting obstacles that have not yet been physically touched.

Visually impaired people usually need some sort of assistance when moving around both in and outside of their homes. Embodiments of this disclosure may eliminate the human error that comes with traditional "white canes" by using electronics to detect objects instead of a physical probing of the surroundings. Thus embodiments may better enable the users to navigate their surroundings.

Some embodiments of this disclosure may provide a way of detecting an obstacle at a longer distance (e.g., several feet) than existing methods. According to some embodiments, a cane may assist the visually impaired by vibrating, making a noise, or performing some other alert functionality when it is in proximity to an object.

It should also be noted that the discussion of a technique in the Background section of this disclosure does not constitute an admission of prior-art status. No such admissions are made herein, unless clearly and unambiguously identified as such.

SUMMARY

In accordance with the teachings of the present disclosure, the disadvantages and problems associated with mobility devices may be reduced or eliminated.

In accordance with embodiments of the present disclosure, a cane apparatus may include a body portion, a handle at a top end of the body portion, a proximity detector coupled to the body portion, an alert mechanism, and a processor communicatively coupled to the proximity detector and the alert mechanism. The processor may be configured to: determine, based on a signal received from the proximity detector, that the proximity detector is within a threshold distance of an obstacle; and based on the determination, activate the alert mechanism.

In accordance with these and other embodiments of the present disclosure, a method may include forming a body portion of a cane from a rigid material; forming a handle at a top end of the body portion; coupling a proximity detector to the body portion; coupling an alert mechanism to the cane; and communicatively coupling a processor to the proximity detector and the alert mechanism. The processor may be configured to: determine, based on a signal received from the proximity detector, that the proximity detector is within a threshold distance of an obstacle; and based on the determination, activate the alert mechanism.

Technical advantages of the present disclosure may be readily apparent to one skilled in the art from the figures, description and claims included herein. The objects and advantages of the embodiments will be realized and achieved at least by the elements, features, and combinations particularly pointed out in the claims.

It is to be understood that both the foregoing general description and the following detailed description are examples and explanatory and are not restrictive of the claims set forth in this disclosure.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Figure 1:
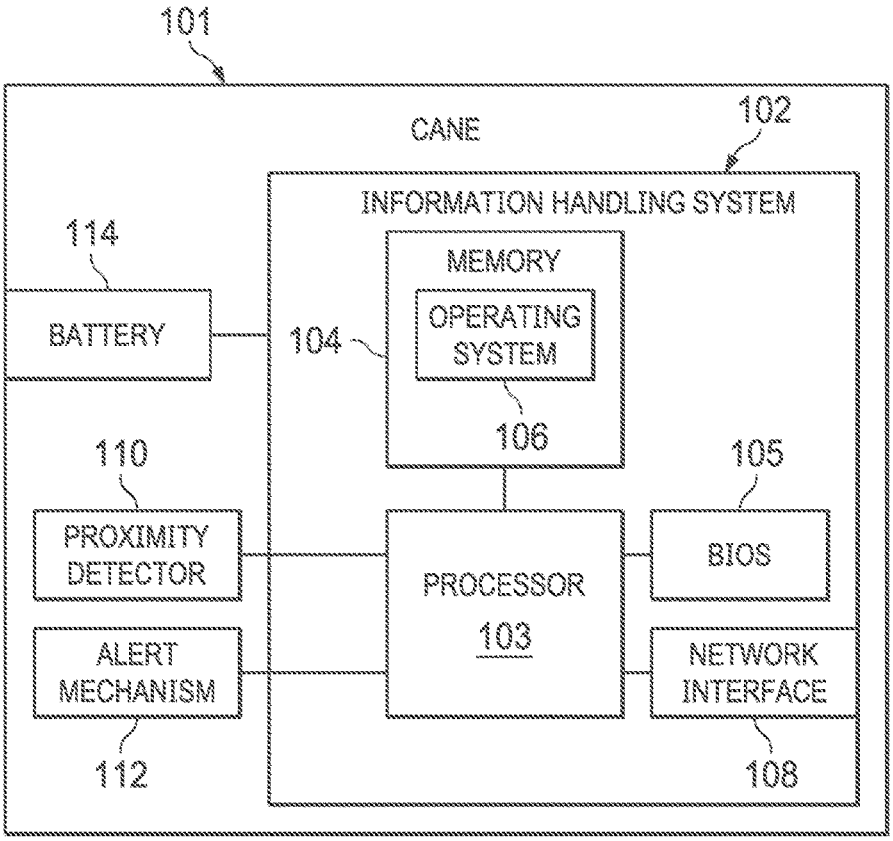
FIG. 1 illustrates a block diagram of an example cane including an information handling system, in accordance with embodiments of the present disclosure.
Figure 2:
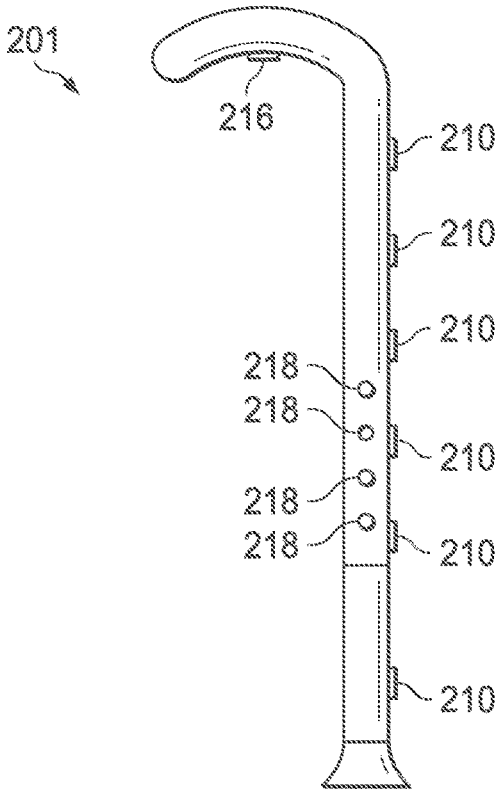
FIG. 2 illustrates a side view of an example cane, in accordance with embodiments of the present disclosure.
Figure 3:
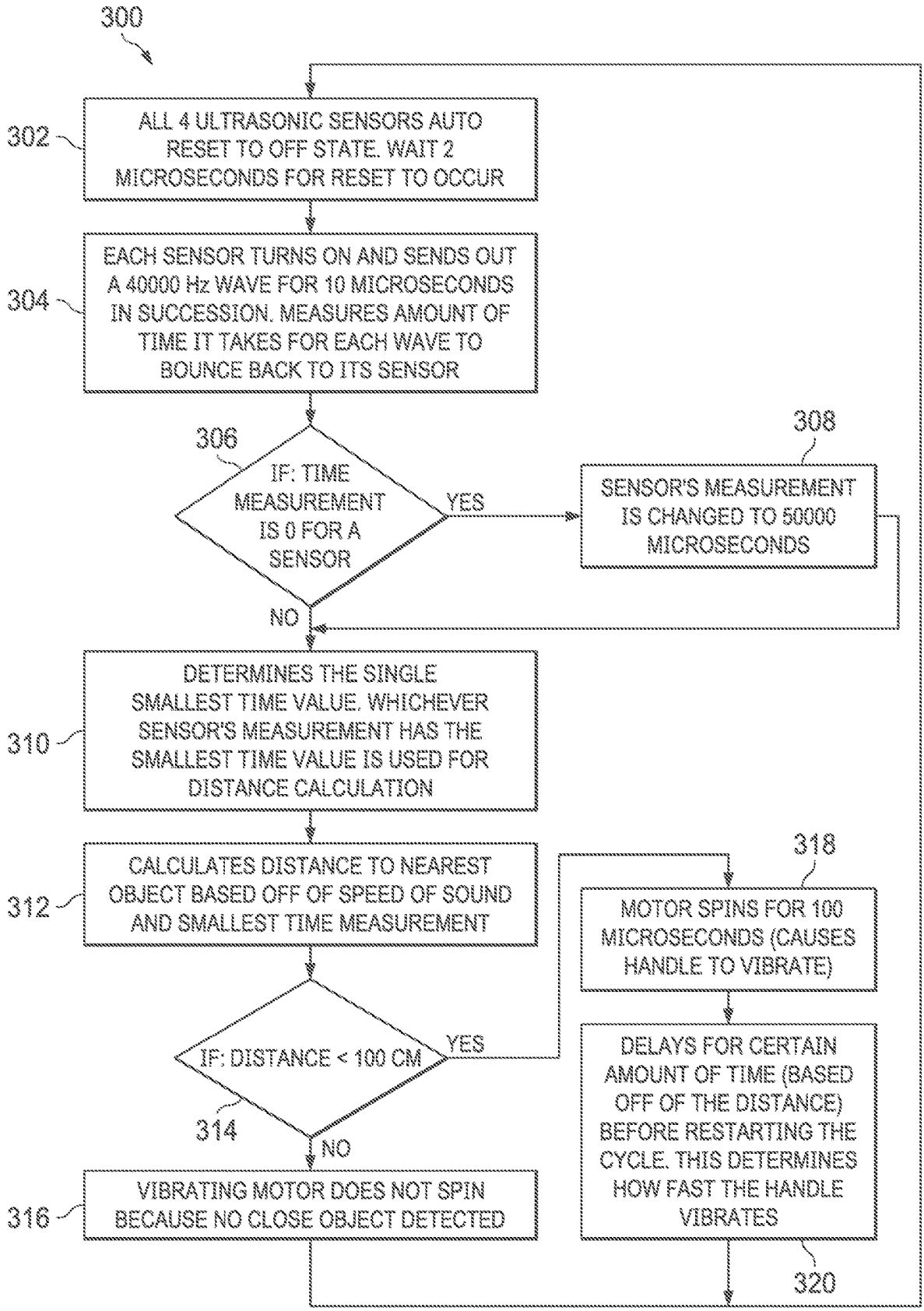
FIG. 3 illustrates a flow chart of an example method, in accordance with embodiments of the present disclosure.

Preferred embodiments and their advantages are best understood by reference to FIGS. 1 through 3, wherein like numbers are used to indicate like and corresponding parts.

For the purposes of this disclosure, the term "information handling system" may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, entertainment, or other purposes. For example, an information handling system may be a personal computer, a personal digital assistant (PDA), a consumer electronic device, a network storage device, or any other suitable device and may vary in size, shape, performance, functionality, and price. The information handling system may include memory, one or more processing resources such as a central processing unit ("CPU") or hardware or software control logic. Additional components of the information handling system may include one or more storage devices, one or more communications ports for communicating with external devices as well as various input/output ("I/O") devices, such as a keyboard, a mouse, and a video display. The information handling system may also include one or more buses operable to transmit communication between the various hardware components.

For purposes of this disclosure, when two or more elements are referred to as "coupled" to one another, such term indicates that such two or more elements are in electronic communication or mechanical communication, as applicable, whether connected directly or indirectly, with or without intervening elements.

When two or more elements are referred to as "coupleable" to one another, such term indicates that they are capable of being coupled together.

For the purposes of this disclosure, the term "computer-readable medium" (e.g., transitory or non-transitory computer-readable medium) may include any instrumentality or aggregation of instrumentalities that may retain data and/or instructions for a period of time. Computer-readable media may include, without limitation, storage media such as a direct access storage device (e.g., a hard disk drive or floppy disk), a sequential access storage device (e.g., a tape disk drive), compact disk, CD-ROM, DVD, random access memory (RAM), read-only memory (ROM), electrically erasable programmable read-only memory (EEPROM), and/ or flash memory; communications media such as wires, optical fibers, microwaves, radio waves, and other electromagnetic and/or optical carriers; and/or any combination of the foregoing.

For the purposes of this disclosure, the term "information handling resource" may broadly refer to any component system, device, or apparatus of an information handling system, including without limitation processors, service processors, basic input/output systems, buses, memories, I/O devices and/or interfaces, storage resources, network interfaces, motherboards, and/or any other components and/or elements of an information handling system.

FIG. 1 illustrates a block diagram of an example cane 101, which may include an information handling system 102, in accordance with embodiments of the present disclosure. Cane 101 may be made of any suitable material (e.g., wood, plastic, steel, aluminum, etc.). In some embodiments, cane 101 may be wholly or partially hollow, in order to provide space for various internal components.

In some embodiments, information handling system 102 of cane 101 may comprise a computer (typically a small-form-factor, portable computer that may be powered by one or more batteries). In some embodiments, information handling system 102 may be a single-board microcontroller system such as an Arduino®, a single-board computer system such as a Raspberry Pi®, or any other suitable system.

As shown in FIG. 1, information handling system 102 may comprise a processor 103, a memory 104 communicatively coupled to processor 103, a BIOS 105 (e.g., a UEFI BIOS) communicatively coupled to processor 103 and configured to initialize information handling resources of information handling system 102, and a network interface 108 communicatively coupled to processor 103. Information handling system 102 may be communicatively coupled to one or more proximity detectors 110 and one or more alert mechanisms 112. In general, information handling system 102 may receive signals from one or more proximity detectors 110, perform processing tasks based on such signals, and activate alert mechanism 112 based on such processing.

Information handling system 102 may be powered by battery 114. In some embodiments, battery 114 may be a rechargeable battery, and it may include a charging port coupled to an exterior surface of cane 101.

In some embodiments, information handling system 102 may be programmed and/or updated via network interface 108, which may couple wirelessly or via a wired connection to an external information handling system. Such programming may be stored in a computer-readable medium of information handling system 102 such as memory 104.

In addition to the elements explicitly shown and described, information handling system 102 may include one or more other information handling resources.

Processor 103 may include any system, device, or apparatus configured to interpret and/or execute program instructions and/or process data, and may include, without limitation, a microprocessor, microcontroller, digital signal processor (DSP), application specific integrated circuit (ASIC), or any other digital or analog circuitry configured to interpret and/or execute program instructions and/or process data. In some embodiments, processor 103 may interpret and/or execute program instructions and/or process data stored in memory 104 and/or another component of information handling system 102.

Memory 104 may be communicatively coupled to processor 103 and may include any system, device, or apparatus configured to retain program instructions and/or data for a period of time (e.g., computer-readable media). Memory 104 may include RAM, EEPROM, a PCMCIA card, flash memory, magnetic storage, opto-magnetic storage, or any suitable selection and/or array of volatile or non-volatile memory that retains data after power to information handling system 102 is turned off.

As shown in FIG. 1, memory 104 may have stored thereon an operating system 106. Operating system 106 may comprise any program of executable instructions (or aggregation of programs of executable instructions) configured to manage and/or control the allocation and usage of hardware resources such as memory, processor time, disk space, and input and output devices, and provide an interface between such hardware resources and application programs hosted by operating system 106. In addition, operating system 106 may include all or a portion of a network stack for network communication via a network interface (e.g., network interface 108 for communication over a data network). Although operating system 106 is shown in FIG. 1 as stored in memory 104, in some embodiments operating system 106 may be stored in storage media accessible to processor 103, and active portions of operating system 106 may be transferred from such storage media to memory 104 for execution by processor 103. In other embodiments (e.g., in which information handling system 102 is a microcontroller system), a full operating system 106 may not be needed. In these and other embodiments, the processor may be configured to execute the desired functionality directly, without an operating system 106 to provide hardware abstraction and the like.

Network interface 108 may comprise one or more suitable systems, apparatuses, or devices operable to serve as an interface between information handling system 102 and one or more other information handling systems via an in-band network. Network interface 108 may enable information handling system 102 to communicate using any suitable transmission protocol and/or standard. In these and other embodiments, network interface 108 may comprise a network interface card, or "NIC." In these and other embodiments, network interface 108 may be enabled as a local area network (LAN)-on-motherboard (LOM) card.

Turning now to FIG. 2, a side view of example cane 201 is shown. As shown, cane 201 includes a handle portion at a top end thereof, a body portion, and a tip at a bottom end thereof. In some embodiments, the tip may be made of rubber or any other suitable material.

Cane 201 is an example of a height-adjustable cane, although other embodiments of this disclosure may not be height-adjustable. The body of cane 201 is divided between a fixed top portion and a movable, extendable bottom portion. For example, the bottom portion may include a smaller diameter which may be insertable into the top portion (or vice versa). A spring-loaded plunger coupled to the bottom portion of the body may be coupleable to one of a plurality of holes 218 disposed in the top portion, allowing a length of cane 201 to be adjusted to fit users having different heights. A biasing spring of such a spring-loaded plunger may prevent the plunger from being accidentally knocked out of the hole 218.

Cane 201 may have a plurality of proximity detectors 210 spaced along its body. For example, in the embodiment shown, proximity detectors 210 may be evenly spaced along a front of the body portion. In some embodiments, proximity detectors 210 may all be disposed on the fixed portion of the body. In other embodiments, one or more of proximity detectors 210 may be disposed on the movable bottom portion of the body.

In various embodiments, proximity detectors 210 may include active and/or passive detectors. For example, ultrasonic transceivers (e.g., an ultrasonic transmitter together with an ultrasonic receiver), optical sensors, electromagnetic sensors, or any other suitable type of sensors may be used.

A processor (e.g., a component of an information handling system) within cane 201 may receive signals from proximity detectors 210. Based on the received signals, the processor may determine a distance for each proximity detector 210 indicative of the distance between that proximity detector and the nearest obstacle. The processor may then determine the overall distance between cane 201 and the nearest obstacle. For example, the overall distance between cane 201 and the nearest obstacle may be determined as the minimum of all of the individual distances measured at each proximity detector 210.

If the determined distance is within a threshold distance, the processor may transmit a signal configured to activate an alert mechanism. For example, such an alert mechanism may include a speaker configured to produce an audible alert. In other embodiments, the alert mechanism may include a vibration motor (e.g., disposed within the handle portion of cane 201) configured to vibrate. Such a vibration motor may include an eccentric rotating mass vibration motor, a linear actuator vibration motor, or any other suitable type of vibration motor.

In some embodiments, the signal transmitted to the alert mechanism may vary based upon one or more determined factors. For example, the frequency of the response generated by the alert mechanism may vary based on the determined distance. For example, the frequency may increase as the distance decreases to alert the user that the obstacle has gotten closer. As one example (described in further detail below with regard to FIG. 3), the alert mechanism may periodically vibrate in a pulsing manner such that the period between successive vibration events decreases (e.g., the frequency of the vibration events increases) with decreasing distance.

Additionally or alternatively, the response generated by the alert mechanism may vary based on which one of the proximity detectors 210 is the closest to an obstacle. Such a feature may be used to indicate to a user whether the obstacle is located relatively low or relatively high, for example.

As one example of such a feature, an audible alert may be used such that the tone generated by a speaker alert mechanism may vary based on which proximity detector 210 is closest to an obstacle. For example, when triggered by a proximity detector 210 that is close to the floor, a low-frequency sound might be used; when triggered by a proximity detector 210 that is higher, a high-frequency sound might be used. Such sound-based alerts may also be pulsed (as described above with regard to vibration alerts) such that the pulse frequency increases with decreasing distance, etc.

As noted above, various components of cane 201 may be powered by an internal battery. In the embodiment shown, such battery may be rechargeable via charging port 216. In other embodiments, disposable batteries may be used.

Turning now to FIG. 3, an example method 300 for operating a cane apparatus is shown, in according with some embodiments. This method may be carried out by a processor of an apparatus such as cane 101 or cane 201 discussed above, or any other suitable apparatus.

For the sake of concreteness in exposition, method 300 describes a particular embodiment in which four ultrasonic sensors are used as the proximity detectors described herein. Further, this embodiment uses a vibration motor as the alert mechanism. One of ordinary skill in the art with the benefit of this disclosure will readily appreciate how method 300 may be modified to apply to various physical embodiments with different characteristics (e.g., different types of proximity sensor, different numbers of proximity sensors, different types of alert mechanisms, etc.).

At step 302 (which may begin, for example, when a power switch of a cane is turned on), the four ultrasonic sensors of the cane are reset to an off state. In some embodiments, such a reset may occur automatically. A delay may be inserted (e.g., a delay of 2 microseconds or any other suitable amount of time) to allow such a reset to complete.

At step 304, each sensor is activated. In some embodiments, the sensors may be activated sequentially (e.g., with a delay of 10 microseconds) such that signals from one sensor do not interfere with another sensor. In this embodiment, each sensor may send out a pulse of ultrasound at a frequency that is not detectable by human ears (e.g., 40 kHz). Based on receiving reflections of such pulses, each sensor may output a result signal that is indicative of the amount of time that has elapsed between sending the pulse and receiving the pulse's reflection.

In this embodiment, the sensors may be configured to output a result of zero if no reflection is detected (e.g., instead of outputting Undefined, NaN, NULL, or some other exceptional value). Accordingly, it may be desirable to detect and discard such zero results. Thus at steps 306 and 308, if a sensor outputs such a zero, its result may be altered to reflect instead some large number rather than zero. (If the zero result were retained, it would interfere with the processing at step 310 discussed below.) In the example shown, the result is altered to 50,000 microseconds, which may be the largest result the sensor is capable of producing. Such a large result may be effectively ignored by subsequent processing steps, as discussed below.

At step 310, the smallest time value of all of the sensors is determined. This may be indicative of the sensor having the smallest distance from an obstacle.

At step 312, the distance to such obstacle is calculated based on the magnitude of the delay and the speed of sound (e.g., 343 meters/second).

At step 314, the calculated distance is compared to some threshold value. For example, a threshold value of 100 cm may be used to ignore obstacles that are detected but are not particularly close to the apparatus. In other embodiments, a different threshold value (e.g., larger or smaller) may be used. If the calculated distance is greater than (greater than or equal to, in some embodiments) the threshold distance, at step 316 the vibration motor is not actuated. The method then returns to step 302 to continue detection of obstacles.

If the calculated distance is within the threshold distance, however, then at step 318 the vibration motor may be actuated for some amount of time (e.g., 100 microseconds).

At step 320, the method may delay for a selected amount of time that may be dependent upon the calculated distance, and then the method may return to step 302 to continue detection of obstacles. For example, a relatively small calculated distance (corresponding to an obstacle that is close) may result in a delay that is small. Thus when method 300 executes again, the result may be a vibration that pulses quickly. On the other hand, a larger calculated distance may result in a delay that is larger, and so the pulse rate may be correspondingly slower. One of ordinary skill in the art with the benefit of this disclosure will understand that various other schemes are possible for alerting the user to the closeness and/or the height of the obstacle.

One of ordinary skill in the art with the benefit of this disclosure will understand that the preferred initialization point for the method depicted in FIG. 3 and the order of the steps comprising that method may depend on the implementation chosen. In these and other embodiments, methods may be implemented as hardware, firmware, software, applications, functions, libraries, or other instructions. Further, although FIG. 3 discloses a particular number of steps to be taken with respect to the disclosed method, the method may be executed with greater or fewer steps than those depicted. The method may be implemented using any of the various components disclosed herein (such as the components of FIG. 1 and/or FIG. 2), and/or any other system operable to implement the method.

Although various possible advantages with respect to embodiments of this disclosure have been described, one of ordinary skill in the art with the benefit of this disclosure will understand that in any particular embodiment, not all of such advantages may be applicable. In any particular embodiment, some, all, or even none of the listed advantages may apply.

This disclosure encompasses all changes, substitutions, variations, alterations, and modifications to the exemplary embodiments herein that a person having ordinary skill in the art would comprehend. Similarly, where appropriate, the appended claims encompass all changes, substitutions, variations, alterations, and modifications to the exemplary embodiments herein that a person having ordinary skill in the art would comprehend. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

Unless otherwise specifically noted, articles depicted in the drawings are not necessarily drawn to scale, although in some embodiments the drawings may be to scale.

Further, reciting in the appended claims that a structure is "configured to" or "operable to" perform one or more tasks is expressly intended not to invoke 35 U.S.C. § 112(f) for that claim element. Accordingly, none of the claims in this application as filed are intended to be interpreted as having means-plus-function elements. Should Applicant wish to invoke § 112(f) during prosecution, Applicant will recite claim elements using the "means for [performing a function]" construct.

All examples and conditional language recited herein are intended for pedagogical objects to aid the reader in understanding the invention and the concepts contributed by the inventor to furthering the art, and are construed as being without limitation to such specifically recited examples and conditions. Although embodiments of the present inventions have been described in detail, it should be understood that various changes, substitutions, and alterations could be made hereto without departing from the spirit and scope of the disclosure.

What is claimed is:

1. A cane apparatus comprising:

a body portion including a plurality of proximity detectors spaced therealong;

a handle at a top end of the body portion;

an alert mechanism; and a processor communicatively coupled to the plurality of proximity detectors and the alert mechanism, wherein the processor is configured to:

receive signals from the plurality of proximity detectors;

adjust the received signals by: in response to receiving, from a particular one of the plurality of proximity detectors, an exceptional value that is indicative of no obstacle being detected, replacing the exceptional value with a value indicative of a largest result the particular proximity detector is capable of producing;

determine, based on the adjusted signals, respective distances from each of the plurality of proximity detectors to an obstacle; and activate the alert mechanism in response to a smallest one of the determined respective distances being less than a threshold distance with a signal that is dependent upon which of the plurality of proximity detectors is associated with the smallest distance such that a frequency associated with the activation of the alert mechanism is set based on a height at which the smallest distance is detected.

2. The cane apparatus of claim 1, wherein each proximity detector comprises an ultrasonic transmitter and an ultrasonic receiver.

3. The cane apparatus of claim 1, wherein the alert mechanism comprises a vibration motor.

4. The cane apparatus of claim 3, wherein the vibration motor comprises an eccentric rotating mass.

5. The cane apparatus of claim 3, wherein the vibration motor comprises a linear actuator.

6. The cane apparatus of claim 1, wherein the alert mechanism comprises a speaker configured to generate an audible alert.

7. The cane apparatus of claim 1, wherein the processor is further configured to:

determine, based on the signals received from the plurality of proximity detectors, a distance between the cane apparatus and the obstacle; and activate the alert mechanism with a second signal that is dependent upon the determined distance.

8. The cane apparatus of claim 7, wherein a frequency of the second signal is based on the determined distance in a way such that a smaller respective distance corresponds to a higher signal frequency.

9. The cane apparatus of claim 1, wherein the exceptional value is a value selected from the group consisting of zero, Undefined, NaN (Not a Number), and NULL.

10. The cane apparatus of claim 1, wherein the value indicative of the large distance is a largest value that the particular proximity detector is capable of producing.

11. A method comprising:

forming a body portion of a cane from a rigid material;

forming a handle at a top end of the body portion;

coupling a plurality of proximity detectors to the body portion such that the plurality of proximity detectors are spaced along the body portion;

coupling an alert mechanism to the cane; and communicatively coupling a processor to the plurality of proximity detectors and the alert mechanism, wherein the processor is configured to:

receive signals from the plurality of proximity detectors;

adjust the received signals by: in response to receiving, from a particular one of the plurality of proximity detectors, an exceptional value that is indicative of no obstacle being detected, replacing the exceptional value with a value indicative of a largest result the particular proximity detector is capable of producing;

determine, based on the adjusted signals, respective distances from each of the plurality of proximity detectors to an obstacle; and activate the alert mechanism in response to a smallest one of the determined respective distances being less than a threshold distance with a signal that is dependent upon which of the plurality of proximity detectors is associated with the smallest distance such that a frequency associated with the activation of the alert mechanism is set based on a height at which the smallest distance is detected.

12. The method of claim 11, further comprising coupling a rubber tip to a bottom end of the body portion.

13. The method of claim 11, wherein the body portion is formed from a fixed portion and an extendable portion.

14. The method of claim 13, wherein the extendable portion is coupled to the fixed portion with a plunger.

15. The method of claim 14, wherein the plunger includes a biasing spring.

16. The method of claim 11, further comprising coupling a rechargeable battery to the cane, the rechargeable battery being configured to provide electrical power to the processor, the plurality of proximity detectors, and the alert mechanism.

17. The method of claim 11, wherein the processor is further configured to activate the alert mechanism with a second signal that is dependent upon which of the plurality of proximity detectors is associated with the smallest distance.

18. The method of claim 11, wherein the processor is further configured to:

determine, based on the signals received from the plurality of proximity detectors, a distance between the cane and the obstacle; and activate the alert mechanism with a second signal that is dependent upon the determined distance.

19. The method of claim 18, wherein a frequency of the second signal is based on the determined distance in a way such that a smaller respective distance corresponds to a higher signal frequency.

* * * * *